US009140205B2

(12) United States Patent
Hermes et al.

(10) Patent No.: US 9,140,205 B2
(45) Date of Patent: Sep. 22, 2015

(54) METHOD AND DEVICE FOR OPERATING A PRESSURE-REGULATING VALVE

(71) Applicants: Henning Hermes, Wolfach (DE); Andreas Sommerer, Kernen (DE); Joerg Nafe, Deckenpfronn (DE); Markus Viereck, Stuttgart (DE)

(72) Inventors: Henning Hermes, Wolfach (DE); Andreas Sommerer, Kernen (DE); Joerg Nafe, Deckenpfronn (DE); Markus Viereck, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 251 days.

(21) Appl. No.: 13/708,382

(22) Filed: Dec. 7, 2012

(65) Prior Publication Data

US 2013/0151123 A1 Jun. 13, 2013

(30) Foreign Application Priority Data

Dec. 9, 2011 (DE) ..... 10 2011 088 115

(51) Int. Cl.

| | |
|---|---|
| ***F02D 41/22*** | (2006.01) |
| ***F02D 41/38*** | (2006.01) |
| ***F02D 41/32*** | (2006.01) |
| ***F02D 41/12*** | (2006.01) |

(52) U.S. Cl.

CPC ..... *F02D 41/3845* (2013.01); *F02D 41/123* (2013.01); *F02D 41/22* (2013.01); *F02D 41/221* (2013.01); *F02D 41/222* (2013.01); *F02D 41/32* (2013.01); *F02D 41/3863* (2013.01); *F02D 2041/223* (2013.01); *F02D 2041/224* (2013.01); *F02D 2200/0602* (2013.01)

(58) Field of Classification Search

CPC ..... F02D 41/22; F02D 41/221; F02D 41/222; F02D 2041/223; F02D 2041/224; F02D 41/3845

USPC ..... 701/104, 114; 123/457, 458, 463, 456, 123/198 D; 73/114.42, 114.43

See application file for complete search history.

(56) References Cited

U.S. PATENT DOCUMENTS

| | | | | |
|---|---|---|---|---|
| 7,121,265 | B2 * | 10/2006 | Joos et al. | 123/494 |
| 7,389,767 | B2 * | 6/2008 | Kasbauer et al. | 123/457 |
| 2009/0177366 | A1 * | 7/2009 | Achleitner et al. | 701/103 |

FOREIGN PATENT DOCUMENTS

DE 10 2010 031 570 1/2012

* cited by examiner

*Primary Examiner* — Mahmoud Gimie

(74) *Attorney, Agent, or Firm* — Kenyon & Kenyon LLP

(57) ABSTRACT

A method for operating a pressure-regulating valve of a fuel injection system of an internal combustion engine of, in particular, a motor vehicle; the fuel injection system including a pressure reservoir for storing pressurized fuel, as well as a feed device for delivering fuel to the pressure reservoir; and fuel being removable from the pressure reservoir via the pressure-regulating valve. In an overrun mode of the internal combustion engine, a delivery quantity of fuel delivered to the pressure reservoir by the feed device is set to a value greater than zero, and that a fuel pressure in the pressure reservoir is ascertained.

15 Claims, 1 Drawing Sheet

METHOD AND DEVICE FOR OPERATING A PRESSURE-REGULATING VALVE

CROSS REFERENCE

The present application claims the benefit under 35 U.S.C. §119 of German Patent Application No. DE 102011088115.8 filed on Dec. 9, 2011, which is expressly incorporated herein by reference in its entirety.

FIELD

The present invention relates to a method and device for operating a pressure-regulating valve of a fuel injection system of an internal combustion engine of, in particular, a motor vehicle; the fuel injection system having a pressure reservoir for storing pressurized fuel and a feed device for delivering fuel to the pressure reservoir, and fuel being removable from the pressure reservoir via the pressure-regulating valve.

SUMMARY

An object of the present invention is to improve a method and a device of the type mentioned at the outset, so as to allow an accurate determination of a current operating state or state of maintenance of a pressure-regulating valve.

According to the present invention, this object may be achieved by delivering a delivery quantity of fuel to the pressure reservoir by the feed device in an overrun mode of the internal combustion engine, the delivery quantity being set to a value greater than zero, and a fuel pressure in the pressure reservoir is ascertained.

In accordance with the present invention, use of the overrun mode of the internal combustion engine for implementing the further method steps has the advantage that instances of removing fuel from the pressure reservoir, as occur, for example, via fuel injectors in a conventional manner, do not take place during the overrun mode, which means that unnecessary effects on the fuel pressure in the pressure reservoir by fuel injections are prevented during the execution of the example method of the present invention. In addition, in contrast to conventional methods, the present invention may advantageously provide that a non-zero delivery quantity of the feed device be set in the overrun mode. This is initially inconsistent with the general requirements for the overrun mode of the internal combustion engine, in that normally, no fuel injections take place at all, and therefore, no delivery quantity has to be provided by the feed device, as well. However, in accordance with the present invention, during the overrun mode, the provision of a non-zero delivery quantity, that is, a delivery quantity greater than zero, advantageously results in generally unwanted pressure drops of the feed device connected to the pressure reservoir being prevented or compensated for. Accordingly, using the determination of the fuel pressure in the pressure reservoir in accordance with the present invention, an operating state or state of maintenance of the pressure-regulating valve may be deduced highly accurately, since it may be assumed that, in particular, negative pressure changes in the pressure reservoir occur solely or predominantly due to the discharge of fuel through the pressure-regulating valve, and not due to generally unwanted leaks in the region of the high-pressure connection of the feed device to the pressure reservoir, as occur in conventional methods in which no fuel is delivered to the pressure reservoir in the overrun mode.

The non-zero delivery quantity advantageously prevents leaks due to dynamic pressure effects in the feed device from occurring during the overrun mode, the leaks also contributing to a pressure drop in the pressure reservoir (that is, in addition to the possibly occurring fuel removal through the pressure-regulating valve). In conventional diagnosing methods for pressure-regulating valves, this has an adverse effect on the accurate derivation of a current operating state or state of maintenance of the pressure-regulating valve from the fuel pressure in the fuel reservoir, since a pressure drop in the pressure reservoir cannot be clearly associated with the pressure-regulating valve, but could also be caused by the above-mentioned leaks.

Therefore, the present invention advantageously provides that a non-zero delivery quantity of fuel to the pressure reservoir be set during the overrun mode of the internal combustion engine, so that the above-described dynamic pressure effects in the feed device are prevented and a substantially leak-free system (except for the outflow of fuel through the pressure-regulating valve in response to the corresponding control pressure being exceeded) is maintained.

In one advantageous specific embodiment of the present invention, it is provided that a time characteristic of the fuel pressure in the pressure reservoir be ascertained, through which operational information about the pressure-regulating valve may be derived particularly accurately. For example, in the overrun mode of the internal combustion engine, a first fuel pressure, which is not sufficient to cause the pressure-regulating valve to open, may initially be present in the pressure reservoir. According to the present invention, as long as a non-zero delivery quantity is introduced into the pressure reservoir in the overrun mode of the internal combustion engine, the pressure in the pressure reservoir increases in a correspondingly continuous manner, so that the control pressure of the pressure-regulating valve is ultimately reached and the pressure-regulating valve assumes an open state that results in a corresponding pressure drop in the pressure reservoir. This pressure drop may be detected by ascertaining the fuel pressure in the pressure reservoir in accordance with the present invention; and the exact value of the fuel pressure in the pressure reservoir, at which the pressure drop or the opening of the pressure-regulating valve takes place, may be advantageously used for ascertaining a current operating state or state of maintenance of the pressure-regulating valve.

In one further advantageous, specific embodiment, the feed device includes a high-pressure pump and a quantity control unit attached to the high-pressure pump on, preferably, the suction side. The quantity control unit may have, for example, an electromagnetic actuator, which acts upon a conventional quantity control valve, which means that by appropriate electrical control of the quantity control unit, a fuel quantity may be selected that is made available to the high-pressure pump on the suction side. The high-pressure pump compresses the fuel provided on the suction side in a conventional manner and delivers it under high pressure to the pressure reservoir.

In a further advantageous, specific embodiment, it is provided that an electromagnetic actuator of the pressure-regulating valve be acted upon by a specifiable control current, through which an opening pressure of the pressure-regulating valve may be advantageously modified. The control current acts in a conventional manner, upon an electromagnetic actuator, which, e.g., may additionally be acted upon by spring elements in such a manner, that an opening pressure of the pressure-regulating valve is determined, on the whole, by the configuration of the spring elements and the value of the control current. The method of the present invention may be advantageously executed for different control current values of the pressure-regulating valve, in which case even more information about the actual operating state or state of maintenance of the pressure-regulating valve is ascertainable.

In a further advantageous, specific embodiment, an operating state of the pressure-regulating valve is deduced as a function of the delivery quantity and the ascertained fuel pressure, and optionally, as a function of the control current of the pressure-regulating valve.

In a further advantageous, specific embodiment, it is provided that a characteristic curve of the pressure-regulating valve, which establishes a relationship between a flow of fuel per unit time and a fuel pressure, be ascertained and/or checked for plausibility.

For example, a characteristic curve, which is for the operation of the pressure-regulating valve and relates the flow rate to the fuel pressure, may be stored in a control device (control unit) controlling the pressure-regulating valve. Using the method of the present invention, the operating states actually occurring in the case of a particular pressure-regulating valve may be identified with regard to the characteristic curve, which means that it may advantageously be determined if the considered pressure-regulating valve substantially corresponds to the stored characteristic curve, or if it lies, for example, beyond a specifiable tolerance range with respect to the predefined characteristic curve, such that reliable operation of the pressure-regulating valve in accordance with the predefined characteristic curve is not possible.

According to the present invention, a complete flow rate/fuel pressure characteristic may be generated, for example, and compared to the predefined characteristic curve, from which, in turn, information about the current operating state or state of maintenance of the pressure-regulating valve and/or of the associated pressure sensor is ascertainable. This may be accomplished, for example, by starting the method of the present invention at a comparatively low fuel pressure in the fuel reservoir, that is, the overrun mode, and by setting a delivery quantity greater than zero. Then, the overrun mode is maintained, for example, at a constant delivery quantity, and the pressure change in the pressure reservoir is ascertained. Initially, a pressure increase occurs in the pressure reservoir, since the non-zero delivery quantity is constantly introduced into the pressure reservoir and the pressure-regulating valve is not already open due to the comparatively low fuel pressure in the fuel reservoir. As soon as a control or opening pressure of the pressure-regulating valve is reached in the pressure reservoir, the pressure-regulating valve opens in a manner known per se, and a pressure value, which is a function of the delivery quantity or delivery rate and the fuel removal rate of the pressure-regulating valve, sets in in the pressure reservoir. Therefore, by evaluating the pressure characteristic during these stages of the method, the actual opening pressure of the pressure-regulating valve may be advantageously deduced, as well as an actual, pressure-dependent flow rate of the pressure-regulating valve, as soon as it has assumed its open state.

In particular, in the case of pressure-regulating valves, whose opening characteristic may additionally be controlled by a control current, the above-mentioned method may also be executed, in each instance, for different values of the control current; the corresponding, actual values of opening pressure, and consequently, an actual operating state and state of maintenance, being ascertainable.

Since the delivery of a zero quantity in the overrun mode is generally prevented during the determination of the fuel pressure in accordance with the example embodiment of the present invention, the opportunities for errors due to leaks in the region of the feed device are advantageously excluded to the greatest possible extent, which means that the ascertained changes in pressure in the pressure reservoir may be advantageously attributed to the pressure-regulating valve alone.

In general, since the example method of the present invention is executed in the overrun mode of the internal combustion engine, while providing a non-zero delivery quantity, particularly low or even zero leakage of the high-pressure system (pressure reservoir, feed device) may be ensured, which means that a particularly accurate determination of the characteristics of the pressure-regulating valve is possible.

Additional features, possible uses and advantages of the present invention are derived from the following description of exemplary embodiments of the present invention, which are illustrated in the figures. In this context, all of the described or illustrated features form the subject matter of the present invention, either alone or in any combination, irrespective of their combination, and irrespective of their wording and illustration below and in the figures, respectively.

DETAILED DESCRIPTION OF EXAMPLE EMBODIMENTS

Figure 1:
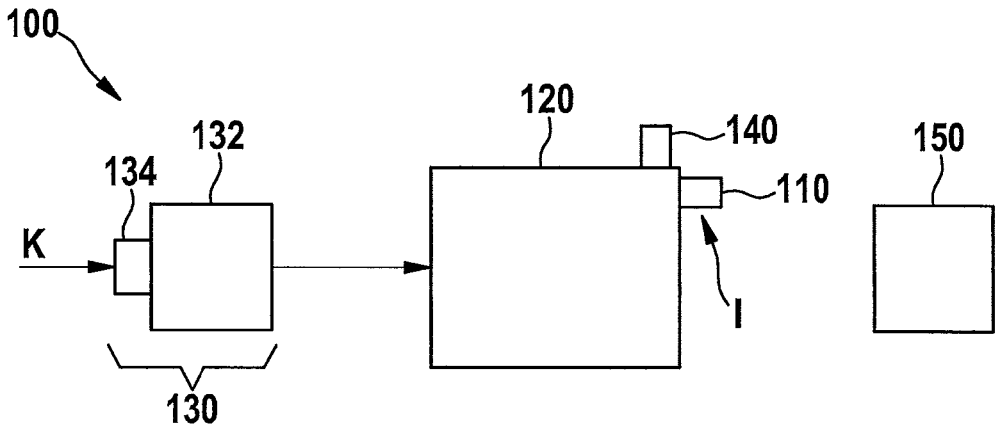
FIG. 1 shows a schematic block diagram of a specific embodiment of the present invention.

FIG. 1 schematically illustrates a block diagram of a fuel injection system 100 of an internal combustion engine. Fuel injection system 100 has a pressure reservoir 120, in which pressurized fuel is stored. Normally, pressure reservoir 120 is also referred to as a rail or common rail. Pressure reservoir 120 is assigned a pressure-regulating valve 110, which is hydraulically connected to pressure reservoir 120 in a conventional manner and assumes an open state when acted upon by specifiable control pressure that is determined, e.g., by an appropriate configuration of spring elements of pressure-regulating valve 110; in the open state of the pressure-regulating valve, fuel being able to escape from pressure reservoir 120 via pressure regulating valve 110, e.g., into a return line of fuel injection system 100 not illustrated in FIG. 1. That is, as soon as the fuel pressure in pressure reservoir 120 exceeds the control pressure, pressure-regulating valve 110 transitions from a closed state into an open state, in which a quantity of fuel per unit time substantially dependent on the fuel pressure is removed from pressure reservoir 120 via pressure-regulating valve 110.

Fuel injection system 100 also includes a feed device 130 for delivering fuel to pressure reservoir 120. Feed device 130 may include, for example, a high-pressure pump 132, to which a quantity control unit 134 is attached on the intake or suction side, the quantity control unit controlling a quantity of fuel supplied to high-pressure pump 132 on the suction side. In this manner, a delivery quantity of fuel K, which is delivered by feed device 130 to pressure reservoir 120, is set.

Pressure reservoir 120 is further assigned a pressure sensor 140, which allows a current fuel pressure in pressure reservoir 120 to be ascertained.

Fuel injection system 100 has a control unit 150, which acquires, for example, the pressure values supplied by pressure sensor 140 and controls the operation of pressure-regulating valve 110 or feed device 130. To that end, control unit 150 may have a processing unit not illustrated, such as a microcontroller on which a corresponding computer program runs.

Figure 2:
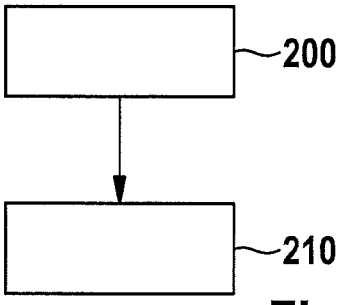
FIG. 2 shows a simplified flow chart of a specific embodiment of the method according to the present invention.

According to an example embodiment of the present invention, a delivery quantity of fuel delivered to pressure reservoir 120 by feed device 130 is set to a value greater than zero in an overrun mode of the internal combustion engine, cf. step 200 of the flow chart from FIG. 2.

Using the overrun mode, it is ensured that for the subsequent steps of the example method of the present invention, fuel is not removed from pressure reservoir 120, e.g., via injectors (not shown). By setting a delivery quantity greater than zero, it is advantageously ensured that for the subsequent steps of the method of the present invention, leaks in the region of the high-pressure connection of feed device 130 to pressure reservoir 120 do not occur, as they do in the case of conventional methods, which do not deliver fuel to the pressure reservoir in the overrun mode.

Therefore, after step 200, a fuel quantity not equal to zero is delivered by feed device 130 to pressure reservoir 120, and due to the non-zero delivery quantity, decreases in pressure caused by leakage through feed device 130 are excluded to the greatest possible extent.

Consequently, the pressure in pressure reservoir 120 is mainly determined by the delivery rate of feed device 130 and a possible occurrence of the opening of pressure-regulating valve 110.

Accordingly, in step 210 (FIG. 2) of the example method of the present invention, a fuel pressure in pressure reservoir 120 is ascertained, for example, in order to determine the fuel pressure in pressure reservoir 120, at which pressure-regulating valve 110 actually transitions from its closed state into the open state ("actual control pressure").

In general, an accurate diagnosis of pressure-regulating valve 110 may be carried out, using the method of the present invention, since on one hand, leaks in the region of feed device 130 are excluded due to the non-zero delivery quantity in the overrun mode, and on the other hand, the overrun also excludes a different type of pressure drop, e.g., by fuel injections. That is, changes in the fuel pressure occurring during the execution of the method of the present invention are to be mainly attributed to pressure-regulating valve 110.

In one advantageous specific embodiment of the present invention, it is provided that a time characteristic of the fuel pressure in pressure reservoir 120 be ascertained, through which operational information about pressure-regulating valve 110 may be derived particularly accurately. For example, in the overrun mode of the internal combustion engine, a first fuel pressure, which is not sufficient to cause pressure-regulating valve 110 to open, may initially be present in pressure reservoir 120. According to the present invention, as long as a non-zero delivery quantity is introduced into pressure reservoir 120 in the overrun mode of the internal combustion engine, the pressure in pressure reservoir 120 increases in a correspondingly continuous manner, which means that the control pressure of pressure-regulating valve 110 is ultimately reached as a second fuel pressure, and pressure-regulating valve 110 assumes an open state that results in a corresponding pressure drop in pressure reservoir 120. This pressure drop may be detected by ascertaining the fuel pressure in pressure reservoir 120 in accordance with the present invention; and the exact value of the fuel pressure in pressure reservoir 120, at which the pressure drop or the opening of pressure-regulating valve 110 takes place, may be advantageously used for ascertaining a current operating state or state of maintenance of pressure-regulating valve 110.

In one further advantageous, specific embodiment, it is provided that an electromagnetic actuator of pressure-regulating valve 110 be acted upon by a specifiable control current I, through which an opening pressure of pressure-regulating valve 110 may be advantageously modified or, in general, a different flow rate/pressure characteristic of pressure-regulating valve 110 may be selected. Control current I acts in a conventional manner, upon an electromagnetic actuator (not shown), which, e.g., may additionally be acted upon by spring elements in such a manner, that an opening pressure of pressure-regulating valve 110 is determined, on the whole, by the configuration of the spring elements and the value of control current I. The method of the present invention may be advantageously executed for different control current values I of pressure-regulating valve 110, in which case even more information about the actual operating state or state of maintenance of pressure-regulating valve 110 is ascertainable.

In a further advantageous, specific embodiment, an operating state of pressure-regulating valve 110 is deduced as a function of the delivery quantity and the ascertained fuel pressure, and optionally, as a function of control current I of pressure-regulating valve 110.

In a further advantageous, specific embodiment, it is provided that a characteristic curve of pressure-regulating valve 110, which establishes a relationship between a flow of fuel per unit time and a fuel pressure, be ascertained and/or checked for plausibility.

Figure 3:
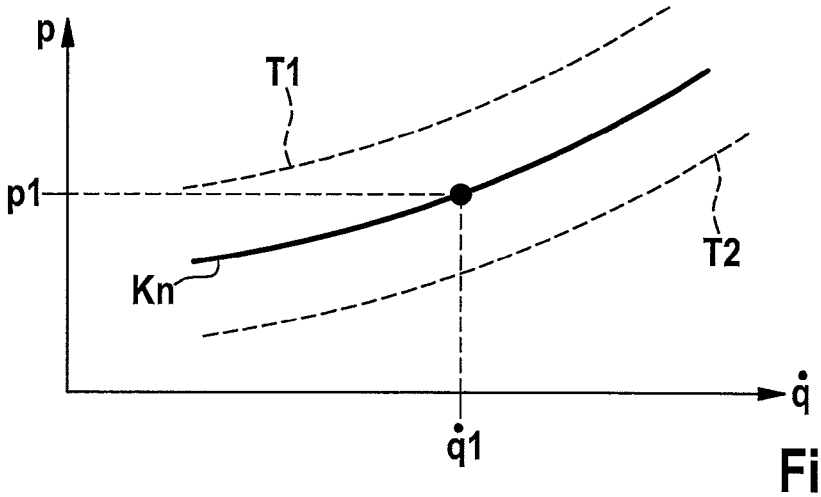
FIG. 3 shows a schematic characteristic curve of a pressure-regulating valve.

FIG. 3 shows, by way of example, a pressure/flow rate characteristic Kn, in which a fuel pressure p is plotted versus a flow rate $\dot{Q}$; the pressure/flow rate characteristic indicating the fuel quantity per unit time that may flow, e.g., out of pressure reservoir 120, through pressure-regulating valve 110 (FIG. 1), at corresponding pressure p.

Characteristic Kn is a characteristic curve of a new system or an ideal characteristic curve of a pressure-regulating valve. Using the method of the present invention, one or more operating points (a value pair of pressure p, flow rate $\dot{Q}$, thus, e.g., (p1, $\dot{Q}$ 1)) of the actual pressure-regulating valve 110 (FIG. 1) in the graph of FIG. 3 may be ascertained, and if the ascertained values of pressure-regulating valve 110 lie in the specifiable tolerance range defined by further characteristics T1, T2, it may be deduced that an operating state or state of maintenance of the pressure-regulating valve 110 tested in accordance with the present invention is good enough to continue operating properly.

If a specifiable number of value pairs obtained using the method of the present invention lie beyond the tolerance range, then it is inferred that pressure-regulating valve 110 is defective, and, e.g., an error response (fault storage entry, signaling) is initiated.

In a particularly advantageous manner, future operation of pressure-regulating valve 110 or of components 130, 100 may also be adapted to the actual characteristic curve of pressure-regulating valve 110.

For example, ideal characteristic Kn (FIG. 3) may be stored in the control device 150 (FIG. 1) that controls pressure-regulating valve 110, and with the aid of the example method of the present invention, operating states actually occurring in a particular, actual pressure-regulating valve 110 may be identified with regard to characteristic curve Kn, which means that it may be advantageously determined if the considered pressure-regulating valve 110 substantially corresponds to stored characteristic curve Kn, or if it lies, e.g., beyond a specifiable tolerance range with respect to specified characteristic Kn, so that reliable operation of the pressure-regulating valve in accordance with the predefined characteristic curve is not possible.

According to the example embodiment of the present invention, a complete flow rate/fuel pressure characteristic may also be generated for a stock valve 110, for example, and compared to predefined characteristic curve Kn in the sense of a plausibility check, from which, in turn, information about the current operating state or state of maintenance of pressure-regulating valve 110 and/or of sensor 140 is ascertainable. This may be accomplished, for example, by starting the example method of the present invention (step 200, 210 from FIG. 2) at a comparatively low fuel pressure in fuel reservoir 120, that is, the overrun mode, and setting a delivery quantity greater than zero. Then, the overrun mode is maintained, for example, at a constant delivery quantity, and the pressure change in pressure reservoir 120 is ascertained. Initially, a pressure increase occurs in pressure reservoir 120, since the non-zero delivery quantity is constantly introduced into pressure reservoir 120 and pressure-regulating valve 110 is not already open due to the comparatively low fuel pressure in fuel reservoir 120. As soon as a control or opening pressure of pressure-regulating valve 110 is reached in pressure reservoir 120, pressure-regulating valve 110 opens in a conventional manner, and a pressure value, which is a function of the delivery quantity or delivery rate and the fuel removal rate of pressure-regulating valve 110, sets in in pressure reservoir 120. Therefore, by evaluating the pressure characteristic during these stages of the method, the actual opening pressure of the pressure-regulating valve may be advantageously deduced, as well as an actual, pressure-dependent flow rate of the pressure-regulating valve, as soon as it has assumed its open state.

A characteristic curve of the type illustrated in FIG. 3 may be ascertained, for example, with knowledge of a time characteristic of the pressure in pressure reservoir 120 and the delivery rate of feed device 130.

In particular, in the case of pressure-regulating valves, whose opening characteristic may additionally be controlled by a control current I, the above-mentioned example method of the present invention may also be executed, in each instance, for different values of control current I; the corresponding, actual values of opening pressure, and consequently, an actual operating state and state of maintenance, being ascertainable.

Since the delivery of a zero quantity in the overrun mode is generally prevented during the determination of fuel pressure p in accordance with the present invention, the opportunities for errors due to leaks in the region of feed device 130 are advantageously excluded to the greatest possible extent, which means that the ascertained changes in pressure in pressure reservoir 120 may be advantageously attributed to pressure-regulating valve 110 alone.

In general, since the example method of the present invention is executed in the overrun mode of the internal combustion engine, while providing a non-zero delivery quantity, particularly low or even zero leakage of the high-pressure system (pressure reservoir 120, feed device 130) may be ensured, which means that a particularly accurate determination of the characteristics of pressure-regulating valve 110 is possible.

Advantageously, the method of the present invention may also be used for checking the plausibility of the fuel pressure in pressure reservoir 120 ascertained with the aid of pressure sensor 140. For example, assuming, preferably, that pressure-regulating valve 110 corresponds to characteristic Kn and operates error-free, it may also be deduced from an operating point actually ascertained with regard to the characteristic curve illustrated in FIG. 3, that pressure sensor 140 is malfunctioning, in particular, if the operating point lies outside of tolerance limits T1, T2.

What is claimed is:

1. A method for operating a pressure-regulating valve of a fuel injection system of an internal combustion engine of a motor vehicle, the method comprising:

in an overrun mode of the internal combustion engine, setting a delivery quantity of fuel delivered to a pressure reservoir by a feed device to a value greater than zero, and ascertaining a fuel pressure in the pressure reservoir, wherein the fuel injection system includes the pressure reservoir for storing pressurized fuel, and the feed device for delivering fuel to the pressure reservoir, and the fuel is removable from the pressure reservoir via a pressure-regulating valve, wherein an electromagnetic actuator of the pressure-regulating valve is acted upon by a specifiable control current; and ascertaining and checking a plausibility of a characteristic curve of the pressure-regulating valve, which establishes a relationship between a flow quantity of fuel per unit time and a fuel pressure.

2. The method as recited in claim 1, further comprising:

ascertaining a time characteristic of the fuel pressure in the pressure reservoir.

3. The method as recited in claim 1, wherein the feed device includes a high-pressure pump and a quantity control unit connected to the high-pressure pump on a suction side.

4. A method for operating a pressure-regulating valve of a fuel injection system of an internal combustion engine of a motor vehicle, the method comprising:

in an overrun mode of the internal combustion engine, setting a delivery quantity of fuel delivered to a pressure reservoir by a feed device to a value greater than zero, and ascertaining a fuel pressure in the pressure reservoir, wherein the fuel injection system includes the pressure reservoir for storing pressurized fuel, and the feed device for delivering fuel to the pressure reservoir, and the fuel is removable from the pressure reservoir via a pressure-regulating valve; and ascertaining an operating state of the pressure-regulating valve as a function of the delivery quantity and the ascertained fuel pressure.

5. The method as recited in claim 4, wherein the operating state is ascertained as a function of a control current acting upon an electromagnetic actuator of the pressure regulation valve.

6. The method as recited in claim 4, further comprising:

ascertaining a time characteristic of the fuel pressure in the pressure reservoir.

7. The method as recited in claim 4, wherein the feed device includes a high-pressure pump and a quantity control unit connected to the high-pressure pump on a suction side.

8. The method as recited in claim 4, wherein an electromagnetic actuator of the pressure-regulating valve is acted upon by a specifiable control current.

9. A method for operating a pressure-regulating valve of a fuel injection system of an internal combustion engine of a motor vehicle, the method comprising:

in an overrun mode of the internal combustion engine, setting a delivery quantity of fuel delivered to a pressure reservoir by a feed device to a value greater than zero, and ascertaining a fuel pressure in the pressure reservoir, wherein the fuel injection system includes the pressure reservoir for storing pressurized fuel, and the feed device for delivering fuel to the pressure reservoir, and the fuel is removable from the pressure reservoir via a pressure-regulating valve; and wherein a characteristic curve of the pressure-regulating valve, which establishes a relationship between a flow quantity of fuel per unit time and a fuel pressure, is at least one of ascertained and checked for plausibility.

10. A device for operating a pressure-regulating valve of a fuel injection system of an internal combustion engine of a motor vehicle, comprising:

a setting and ascertaining arrangement to set a delivery quantity of fuel delivered to a pressure reservoir by a feed device to a value greater than zero and to ascertain a fuel pressure in the pressure reservoir, in an overrun mode of the internal combustion engine, wherein the fuel injection system includes the pressure reservoir for storing pressurized fuel, and the feed device for delivering fuel to the pressure reservoir, and the fuel is removable from the pressure reservoir via the pressure-regulating valve;

wherein the arrangement is configured to ascertain an operating state of the pressure-regulating valve as a function of the delivery quantity and the ascertained fuel pressure.

11. The device as recited in claim 10, wherein the device is configured to ascertain the operating state of the pressure-regulating valve as a function of a control current applied to an electromagnetic actuator of the pressure-regulating valve.

12. The device as recited in claim 10, wherein the arrangement is configured to apply a specifiable control current to an electromagnetic actuator of the pressure-regulating valve.

13. The device as recited in claim 12, wherein the arrangement is configured to ascertain the operating state of the pressure-regulating valve as a function of a control current applied to an electromagnetic actuator of the pressure-regulating valve.

14. The device as recited in claim 12, wherein the arrangement is configured to at least one of ascertain and check the plausibility of a characteristic curve of the pressure-regulating valve, which establishes a relationship between a flow quantity of fuel per unit time and a fuel pressure.

15. A device for operating a pressure-regulating valve of a fuel injection system of an internal combustion engine of a motor vehicle, comprising:

a setting and ascertaining arrangement to set a delivery quantity of fuel delivered to a pressure reservoir by a feed device to a value greater than zero and to ascertain a fuel pressure in the pressure reservoir, in an overrun mode of the internal combustion engine, wherein the fuel injection system includes the pressure reservoir for storing pressurized fuel, and the feed device for delivering fuel to the pressure reservoir, and the fuel is removable from the pressure reservoir via the pressure-regulating valve;

wherein the arrangement is configured to at least one of ascertain and check the plausibility of a characteristic curve of the pressure-regulating valve, which establishes a relationship between a flow quantity of fuel per unit time and a fuel pressure.

* * * * *